US007360547B2

(12) United States Patent
Carlson

(10) Patent No.: US 7,360,547 B2
(45) Date of Patent: Apr. 22, 2008

(54) WALKING ASSIST DEVICE AND ASSOCIATED METHODS

(76) Inventor: Ann M. Carlson, 613 Papaya Cir., Barefoot Bay, FL (US) 32976

( * ) Notice: Subject to any disclaimer, the term of this patent is extended or adjusted under 35 U.S.C. 154(b) by 331 days.

(21) Appl. No.: 10/968,381

(22) Filed: Oct. 19, 2004

(65) Prior Publication Data

US 2006/0081279 A1 Apr. 20, 2006

(51) Int. Cl.
*A45B 1/00* (2006.01)

(52) U.S. Cl. ..... 135/66; 135/84; 135/79

(58) Field of Classification Search ..... 135/65–66, 135/76–79, 84, 86; D3/5–7, 17, 10; 248/188.9, 248/345.1; 280/819, 821
See application file for complete search history.

(56) References Cited

U.S. PATENT DOCUMENTS

| | | | | | |
|---|---|---|---|---|---|
| 3,223,099 | A | * | 12/1965 | Hagood, Sr. | 135/85 |
| 3,948,535 | A | * | 4/1976 | Negi | 280/816 |
| 4,630,626 | A | | 12/1986 | Urban | 135/84 |
| 4,899,771 | A | * | 2/1990 | Wilkinson | 135/77 |
| 5,167,746 | A | * | 12/1992 | Sheenan | 156/293 |
| 5,301,703 | A | | 4/1994 | Kahn | 135/77 |
| 5,301,704 | A | | 4/1994 | Brown | 135/78 |
| 5,331,989 | A | | 7/1994 | Stephens | 135/65 |
| 5,353,825 | A | * | 10/1994 | Davis | 135/78 |
| 5,392,801 | A | | 2/1995 | Hannoosh et al. | 135/65 |
| 5,409,029 | A | | 4/1995 | Davis | 135/68 |
| 5,465,745 | A | | 11/1995 | Davis | 135/82 |
| 5,575,299 | A | * | 11/1996 | Bieri | 135/66 |
| 5,713,382 | A | | 2/1998 | Midcap | 135/84 |
| 6,003,533 | A | | 12/1999 | Midcap | 135/84 |
| 6,085,766 | A | * | 7/2000 | Geary | 135/75 |
| 6,131,593 | A | * | 10/2000 | Greene et al. | 135/77 |
| 6,217,073 | B1 | * | 4/2001 | Hoffman | 280/823 |
| 6,276,007 | B1 | * | 8/2001 | Brown | 5/81.1 R |
| D481,531 | S | * | 11/2003 | Haythornthwaite | D3/12 |

FOREIGN PATENT DOCUMENTS

| | | | |
|---|---|---|---|
| JP | 8-89322 | * | 4/1996 |

* cited by examiner

*Primary Examiner*—Winnie Yip
(74) *Attorney, Agent, or Firm*—Mark R Malek, Esq.; Zies Widerman Sutch & Malek

(57) ABSTRACT

A walking assist device includes an elongate shaft having an adjustable length, a handle detachably connected to a proximal end of the elongate shaft, and a curved elongate base that matingly engages a distal end of the elongate shaft. The curved elongate base may have a curved top, a front wall, a rear wall, a pair of opposing sidewalls, and a curved bottom. The curved elongate base may also include a plurality of spaced apart ribs connected to and extending outwardly from the curved bottom, and a connection member connected to and extending outwardly from the curved top to matingly engage the distal end of the elongate shaft.

29 Claims, 6 Drawing Sheets

U
15
20
22
17
30
10
40
52
50
26
42

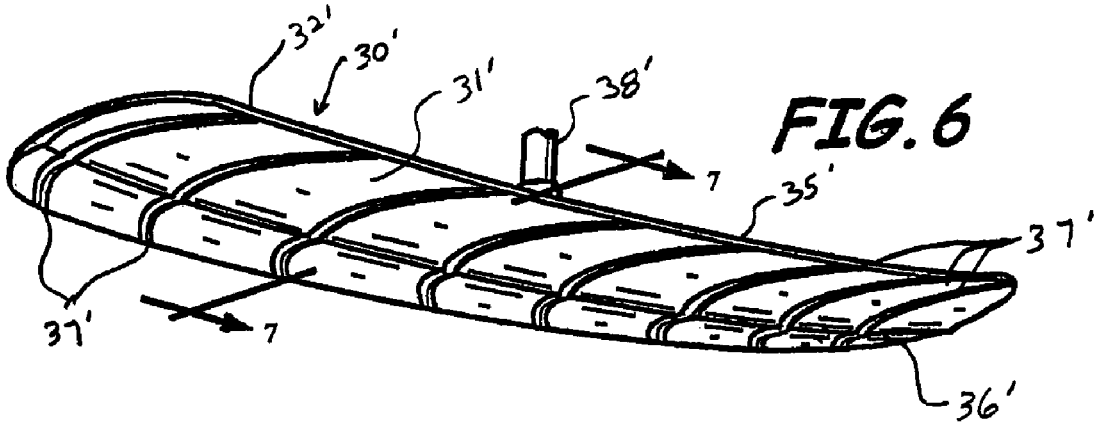
FIG. 6
FIG. 7
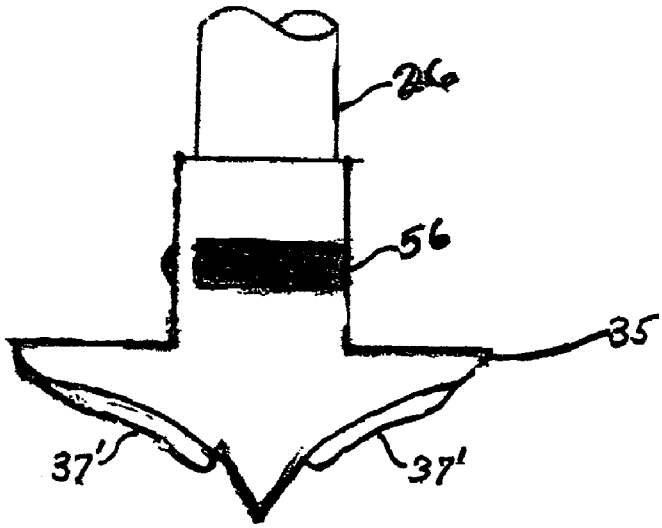

WALKING ASSIST DEVICE AND ASSOCIATED METHODS

FIELD OF THE INVENTION

The present invention relates to the field of a walking assist device and, more particularly, to a walking assist device having an elongate base and related methods.

BACKGROUND OF THE INVENTION

Walking aids, such as canes and crutches, for example, are widely used to assist people that may have difficulty walking due to various physical ailments. Many walking aids include an elongate shaft, a handle, and a rubber tip base, such as the base disclosed in U.S. Pat. No. 4,630,626 to Urban. The rubber tip base may provide grip as the user engages the base of the walking aid to a compact and substantially smooth surface, such as asphalt or concrete, for example.

Walking aids having rubber tip bases, however, or any other type of base having smaller diameters, i.e., diameters that are substantially similar to that of the elongate shaft, are not advantageous when used on a surface of loose material, such as sand, for example. U.S. Pat. No. 4,899,771 to Wilkinson, discloses a walking aid having an elongate base and a plurality of spaced apart ridges extending longitudinally the length of the base, i.e., extending the direction of use when the walking aid is in motion. The front wall and rear wall of the elongate base are curved upwardly. Such a base, however, may not be sufficient to provide grip when being used on a surface having loose material, such as sand, for example.

Many walking aids also provide an elongate shaft having an adjustable length, such as disclosed in U.S. Pat. No. 5,301,704 to Brown. Brown discloses a walking aid having a first elongate shaft, and a second elongate shaft that slidably engages the first elongate shaft. More specifically, a plurality of pairs of passageways may be aligned and fastened together so that the overall length of the elongate shaft may be adjusted depending on a user's height.

SUMMARY OF THE INVENTION

In view of the foregoing background, it is therefore an object of the present invention to provide a walking assist device for use on a surface of loose material, e.g., sand.

It is also an object of the present invention to provide a walking assist device having interchangeable bases so that a user may interchange a base suitable for use on a surface with loose material, such as sand, for example, with a base that is suitable for use on a surface of compact and smoother material, such as asphalt and concrete, for example.

It is further an object of the present invention to provide a walking assist device having an adjustable length so that a user may readily adjust the overall length of the walking assist device to a length suitable for the user's height.

These and other objects, features, and advantages in accordance with the present invention are provided by a walking assist device comprising an elongate shaft having an adjustable length, and a curved elongate base connected thereto. More particularly, the elongate shaft has a proximal end and a distal end. The walking assist device may also comprise a handle connected to the proximal end of the elongate shaft.

The curved elongate base may matingly engage the distal end of the elongate shaft, and may have a curved top, a front wall, a rear wall, a pair of opposing sidewalls, and a curved bottom. The curved bottom has a major axis extending from the front wall to the rear wall, substantially the length of the curved elongate base.

The curved elongate base may also comprise a plurality of spaced apart ribs connected to and extending outwardly from the curved bottom. The plurality of spaced apart ribs may advantageously provide additional stability when in contact with a surface of loose material, such as beach sand, for example, or any other similar type of loose material.

The curved elongate base may further comprise a connection member connected to and extending outwardly from the curved top to matingly engage the distal end of the elongate shaft. The plurality of spaced apart ribs, curved top, front wall, rear wall, opposing sidewalls, curved bottom, and connection member of the curved elongate base may be integrally formed as a monolithic unit.

The walking assist device may also comprise a base storage member connected to and extending outwardly from the elongate shaft. The base storage member and the first elongate shaft may advantageously be integrally formed as a monolithic unit. The curved elongate base may advantageously be moved between a storage position and a use position. The connection member on the curved elongate base may matingly engage the base storage member on the elongate shaft when the curved elongate base is in the storage position.

The curved elongate base may be a first base, and the walking assist device may further comprise a second base. The second base may advantageously be interchangeably connected with the first base to the distal end of the elongate shaft. Further, the second base may also be moved between a storage position and a use position. When in the storage position, the second base may matingly engage the base storage member on the elongate shaft. This configuration of the base storage member advantageously allows a user to readily switch bases between the curved elongate base, which is preferably suitable for use on a loose surface, and the second base, which is preferably suitable for use on a more compact or smooth surface, such as asphalt, concrete, tile, or any other similar surface.

The handle may be shaped to contour the shape of a hand of a user. Such a handle may advantageously provide additional comfort to the user when using the walking assist device. This type of handle may additionally provide enhanced support to the user.

The elongate shaft may comprise first and second elongate shafts that slidably engage one another. Each of the first and second elongate shafts may include a pair of opposing shaft passageways formed therein so that respective pairs of opposing shaft passageways may align when the second elongate shaft slidably engages the first elongate shaft. The walking assist device may further comprise a shaft fastener for engaging respective pairs of opposing shaft passageways. This configuration may advantageously allow the length of the elongate shaft to be readily adjusted to better suit the height of a user.

The connection member may include a pair of opposing connection member passageways formed therein, and the elongate shaft may also include a pair of opposing connection member passageways formed therein. The walking assist device may also comprise a base fastener for engaging the respective pairs of opposing connection member passageways to fasten the curved elongate base to the second elongate shaft.

A method aspect of the present invention is for using the walking assist device. The method may comprise matingly engaging the curved elongate base to the distal end of the elongate shaft. The method may also comprise moving the curved elongate base from a use position connected to the distal end of the elongate shaft, to a storage position, matingly engaging a base storage member on the elongate shaft.

BRIEF DESCRIPTION OF THE DRAWINGS

FIG. 6 is a partial perspective view of another embodiment of the curved elongate base of the walking assist device according to the present invention.

FIG. 7 is a cross sectional view of the curved elongate base shown in FIG. 6 taking through line 7-7.

DETAILED DESCRIPTION OF THE PREFERRED EMBODIMENTS

Figure 1:
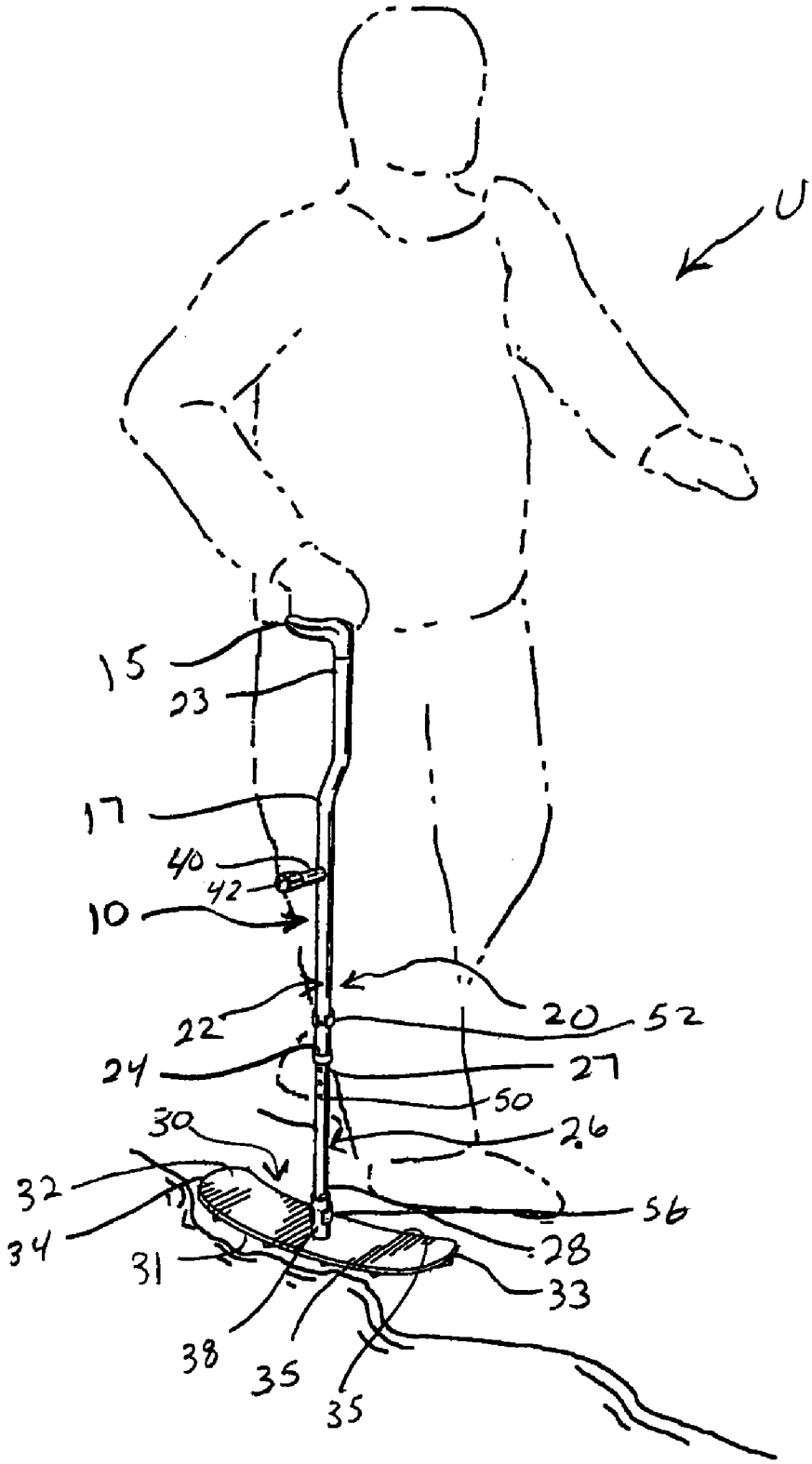
FIG. 1 is a partial environmental view of a walking assist device according to the present invention in use.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime and multiple prime notation is used to indicate similar elements in alternate embodiments.

Referring initially to FIGS. 1-4, a walking assist device 10 according to the present invention is now described. The walking assist device 10 of the present invention is preferably used on a loose surface, such as sand, for example, or any other similar surface. Those skilled in the art will appreciate, however, that the walking assist device 10 of the present invention may be used on any surface. The walking assist device 10 illustratively comprises an elongate shaft 20 having an adjustable length. More specifically, the elongate shaft 20 may include a first elongate 22 shaft having a proximal end 23 and a distal end 24, and a second elongate shaft 26 having a proximal end 27 and a distal end 28. The first and second elongate shafts 22, 26 slidably engage one another. More specifically, the proximal end 27 of the second elongate shaft 26 illustratively slidably engages the distal end 24 of the first elongate shaft 22 so that the first elongate shaft overlies the second elongate shaft. Those having skill in the art will appreciate that the elongate shaft 20 may also be configured so that the second elongate shaft 26 overlies the first elongate shaft 22. The elongate shaft 20 is preferably made of a lightweight, high strength, and non-corrosive material, such as aluminum, for example, or any other similar material as understood by those skilled in the art.

The first elongate shaft 22 is preferably an outer elongate shaft, and the second elongate shaft 26 is preferably an inner elongate shaft. More particularly, the first elongate shaft 22 may have a first predetermined diameter and the second elongate shaft 26 may have a second predetermined diameter that is less than the first predetermined diameter. Accordingly, when the first and second elongate shafts 22, 26 slidably engage one another, the second elongate shaft overlies the first elongate shaft.

The walking assist device 10 also illustratively comprises a handle 15. The handle 15 is illustratively connected to the proximal end 23 of the first elongate shaft 22. The handle 15 may be detachably connected to the proximal end 23 of the first elongate shaft 22, if desired by a user U. The handle 15 may be shaped to contour the hand of the user U. Accordingly, such a handle 15 may advantageously be more comfortable for a user U. Of course, those skilled in the art will appreciate that the handle 15 may have any shape, such as a traditional "J" shape, for example.

Figure 2:
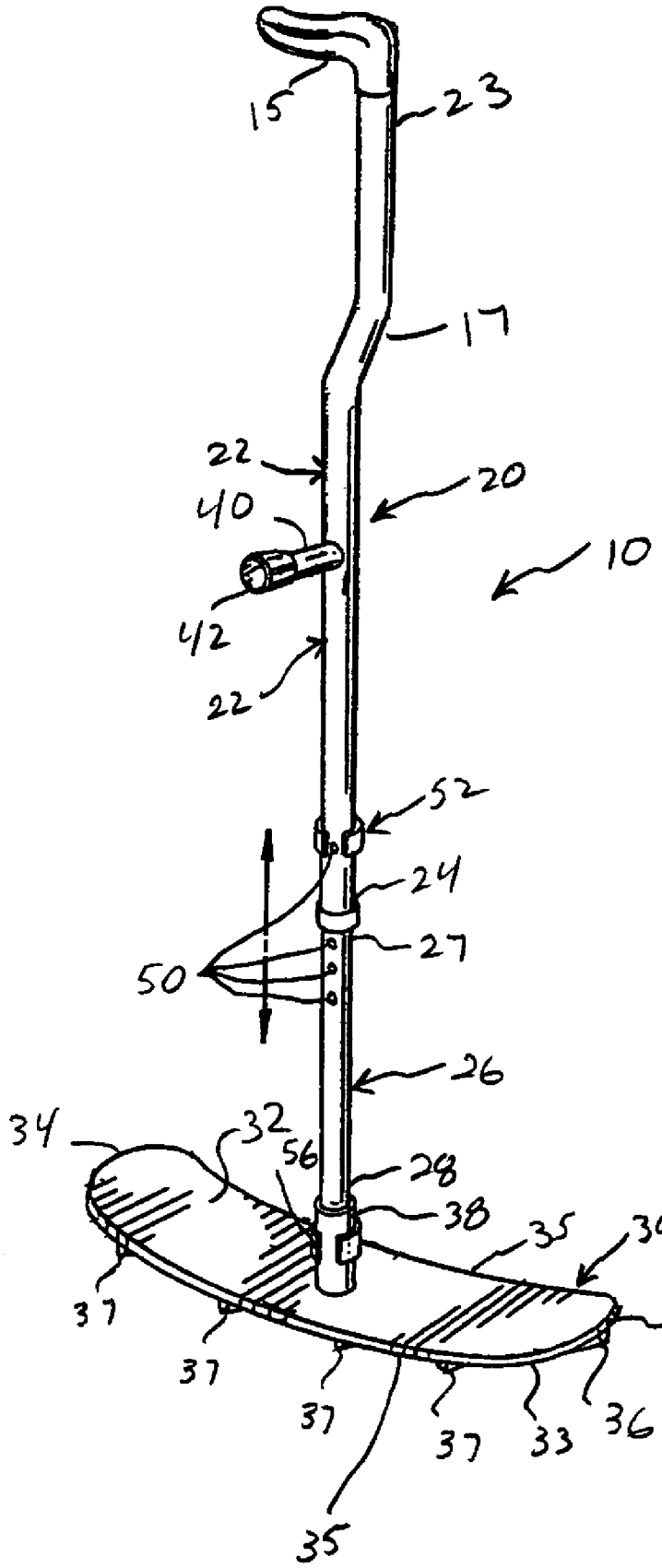
FIG. 2 is a perspective view of the walking assist device illustrated in FIG. 1.
Figure 3:
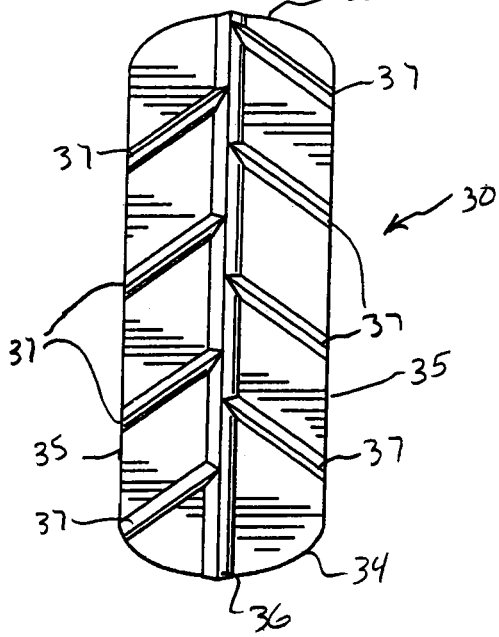
FIG. 3 is an exploded perspective view of the walking assist device illustrated in FIG. 1.
Figure 3:
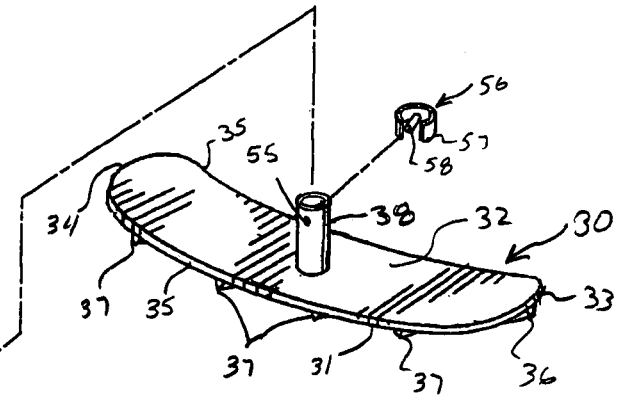

As illustrated in FIGS. 2 and 3, for example, the first elongate shaft 22 may have a curve 17 formed therein between the distal end 24 of the first elongate shaft and the handle 15. The curve 17 may advantageously enhance ergonomics of the walking assist device.

The walking assist device also illustratively includes a curved elongate base 30. The curved elongate base 30 illustratively detachably connects to the distal end 28 of the second elongate shaft 26. Further, the curved elongate base 30 comprises a curved bottom 31, a curved top 32 overlying the curved bottom, a front wall 33, a rear wall 34, and opposing sidewalls 35.

Figure 4:
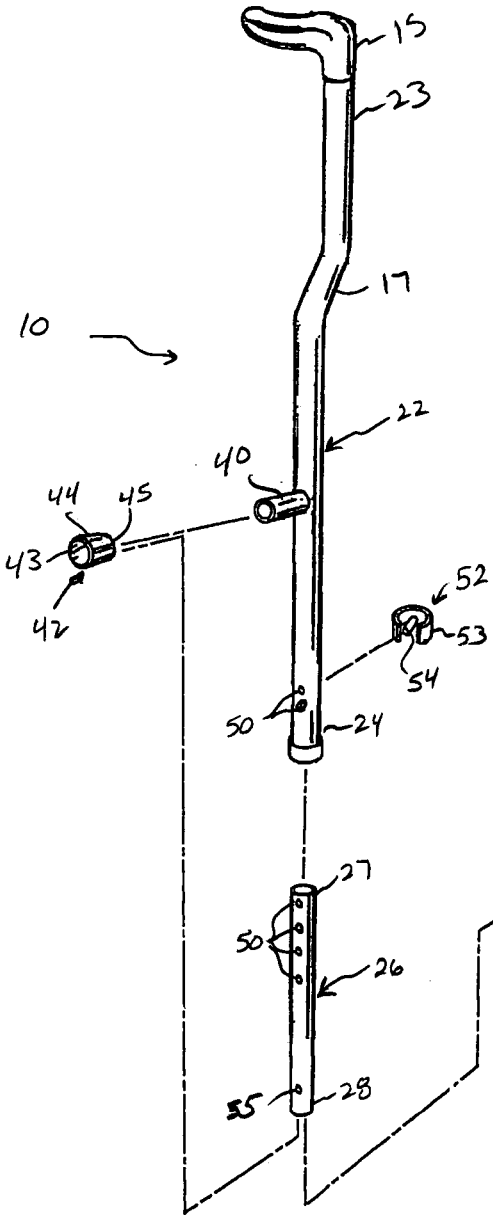
FIG. 4 is a bottom plan view of a curved elongate base of a walking assist device illustrated in FIG. 1.

As perhaps best illustrated in FIG. 4, the curved elongate base 30 may illustratively include a medial rib 36 connected to and extending outwardly from a medial portion of the curved bottom 31. The medial rib 36 preferably has a length substantially similar to the length of the curved elongate base 30. The curved elongate base 30 may also illustratively include a plurality of auxiliary ribs 37 extending outwardly from the curved bottom 31. The plurality of auxiliary ribs 37 are preferably alternatingly spaced apart on opposing sides of the medial rib 36. Further, each of the plurality of auxiliary ribs 37 preferably extends laterally from the medial rib 36 substantially to the opposing sidewalls 35 of the curved elongate base 30. Those skilled in the art will appreciate that the auxiliary ribs 37 need not extend to the end of the curved bottom 31, i.e., to the opposing sidewalls 35, to accomplish the purpose of the present invention.

Accordingly, this configuration of the curved bottom 31 of the curved elongate base 30 advantageously provides additional stability when using the walking assist device to engage a loose surface, such as beach sand, for example, or a similar loose surface. More specifically, the configuration of the medial rib 36 and the plurality of alternating auxiliary ribs 37 advantageously provides additional grip when engaging such a loose surface. As also perhaps best illustrated in FIG. 4, each of the medial rib 36 and plurality of auxiliary ribs 37 preferably have a triangular shape with the base of the triangle contacting the curved bottom 31, and ending outwardly there from to a tip.

The curved elongate base 30 may further comprise a connection member 38 connected to and extending outwardly from the curved top 32. The connection member 38 may illustratively matingly engage the distal end 28 of the second elongate shaft 26 to thereby fasten the curved elongate base 30 to the elongate shaft 20.

The curved elongate base 30 is preferably made of a lightweight high strength material, such as a plastic, a composite, or any other similar material, as understood by those skilled in the art. The curved bottom 31, curved top 32, front wall 33, rear wall 34, opposing sidewalls 35, medial rib 36, plurality of auxiliary ribs 37, and connection member 38 of the curved elongate base 30 may be integrally formed as a monolithic unit. More specifically, the curved elongate base 30 may be manufactured using injection molding. Accordingly, manufacturing costs of the curved elongate base 30 may advantageously be minimized.

As perhaps best illustrated in FIGS. 2 and 3, the walking assist device 10 may also include a base storage member 40. The base storage member 40 is illustratively connected to the first elongate shaft 22, and preferably adjacent the proximal end 23 of the first elongate shaft. Of course, those skilled in the art will appreciate that the base storage member 40 may advantageously be positioned adjacent any portion of the elongate shaft 20. The base storage member 40 may be connected to the first elongate shaft 22 using a welded connection, or any other similar connection as understood by those skilled in the art. Those skilled in the art will also appreciate that the base storage member 40 and the first elongate shaft 22 may be integrally formed as a monolithic unit.

Figure 5:
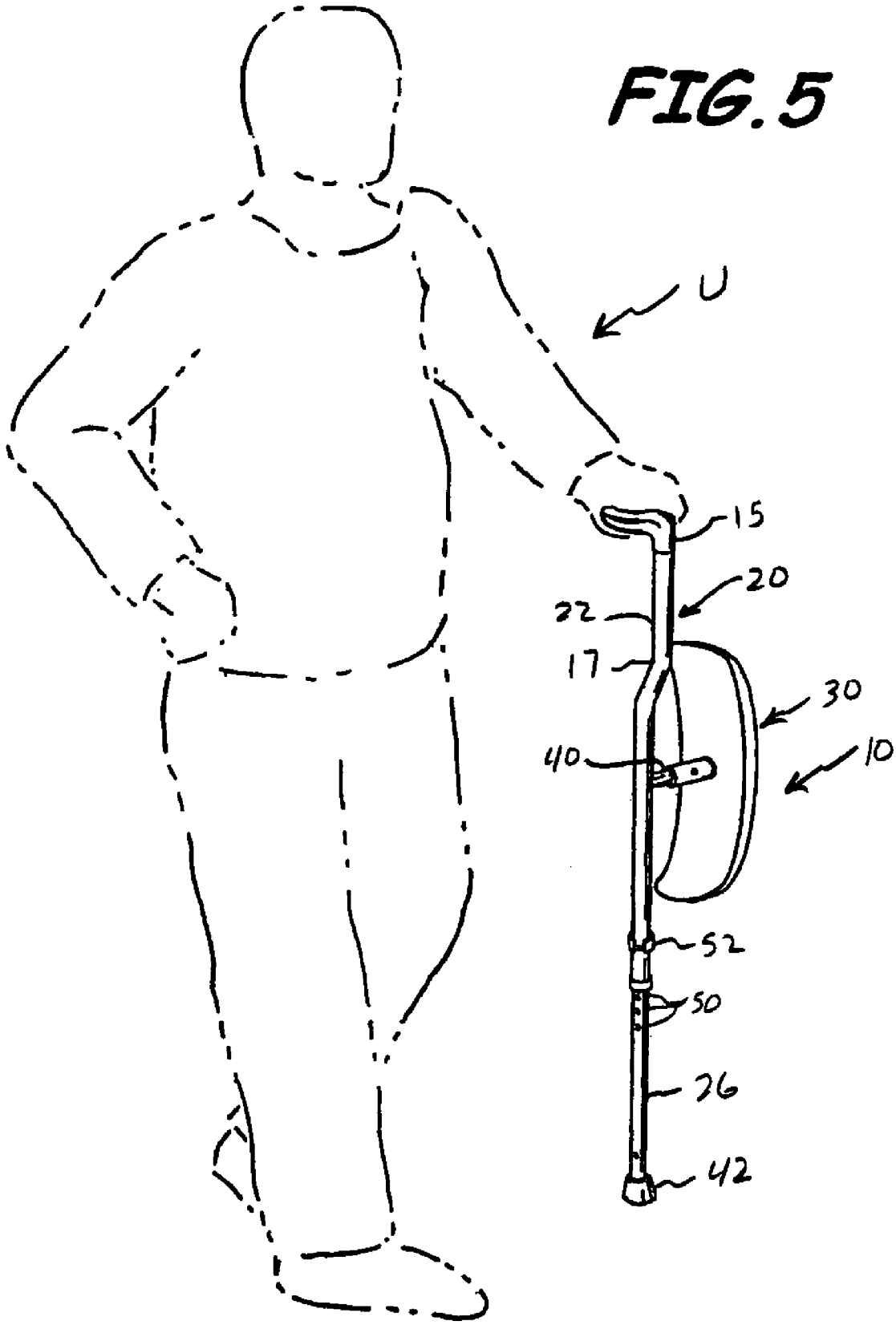
FIG. 5 is a partial environmental view of a walking assist device in use showing a curved elongate base in a storage position.

As perhaps best illustrated in FIGS. 1 and 5, the curved elongate base 30 is preferably movable between a storage position and a use position. More specifically, the curved elongate base 30 is illustrated in the use position in FIG. 1, and the storage position in FIG. 2. When in the use position, the connection member 38 of the curved elongate base 30 may matingly engage the distal end 28 of the second elongate shaft 26. When in the storage position, the connection member 38 of the curved elongate base 30 may matingly engage the base storage member 40. Accordingly, the user U may advantageously readily store the curved elongate base 30 when not in use.

As perhaps best illustrated in FIG. 3, the curved elongate base 30 is a first base, and the walking assist device may also include a second base 42 that interchangeably connects with the curved elongate base 30 to the distal end 28 of the second elongate shaft 26. The second base 42 may, for example, be a traditional rubber tip base, as understood by those skilled in the art. Such a base includes a bottom 43, sidewalls 44, and an open top 45 having a diameter slightly larger than the diameter of the second elongate shaft 26 so that the second base 42 may slidably engage either the distal end 28 of the second elongate shaft or the base storage member 40, as necessary.

Similar to the curved elongate base 30, the second base 42 is movable between a storage position and a use position. When in the use position, the second base 42 matingly engages the distal end 28 of the second elongate shaft 26, as perhaps best illustrated in FIG. 6. When in the storage position, the second base 42 matingly engages the base storage member 40, as perhaps best illustrated in FIG. 1.

The first and second elongate shafts 22, 26 may illustratively include a plurality of pairs of shaft passageways 50 formed therein. More particularly, the first elongate shaft 22 preferably includes a pair of opposing shaft passageways 50 formed therein. The second elongate shaft 26 preferably includes a plurality of pairs of shaft passageways 50 formed therein. Those skilled in the art will appreciate that any number of pairs of opposing shaft passageways 50 may be formed in the first and second elongate shafts 22, 26. When the first and second elongate shafts 22, 26 slidably engage one another, one of the respective pairs of shaft passageways 50 on the second elongate shaft 26 preferably aligns with the pair of opposing shaft passageways on the first elongate shaft 22.

The walking assist device 10 also includes a shaft fastener 52 for engaging the plurality of pairs of shaft passageways 50. When one of the pairs of opposing shaft passageways 50 on the second elongate shaft 26 is in alignment with the pair of opposing shaft passageways on the first elongate shaft 22, the shaft fastener 52 may engage the pairs of shaft passageways to thereby lock the length of the elongate shaft 20 in place.

The connection member 38 of the curved elongate base 30 may also include at least one pair of opposing connection member passageways 55 formed therein. Further, the second elongate shaft 26 preferably also includes at least one pair of opposing connection member passageways 55 formed therein. Those skilled in the art will appreciate that any number of connection member passageways 55 may be formed in each of the connection member 38 and the second elongate shaft 26.

The walking assist device 10 also illustratively comprises a base fastener 56 for engaging at least one of the pair of opposing connection member passageways 55 on the connection member 38, and at least one of the pair of opposing connection member passageways on the second elongate shaft 26 to thereby fasten the curved elongate base 30 to the distal end 28 of the second elongate shaft.

The shaft fastener 52 and the base fastener 56 are similarly shaped and sized. More specifically, and as perhaps best illustrated in FIG. 3, each of the shaft fastener 52 and base fastener 56 have a respective housing 53, 57 that is a substantially C-shaped, and a respective engagement rod 54, 58 extending outwardly from an inner portion of the C-shaped housing. More particularly, the C-shaped housing 53, 57 of the shaft fastener 52 and the base fastener 56 preferably comprise flexible material so that the open portion of the C-shaped housing may be flexed to overlie the connection member 38, the first elongate shaft 22, the second elongate shaft 26, and the base storage member 40. Those skilled in the art will appreciate that the base fastener 56 may be used to lock the elongate base 30 on the base storage member 40 when the elongate base is in the storage position. Accordingly, the base storage member 40 may include at least one pair of opposing connection member passageways (not shown) to receive the base fastener 56.

Referring now additionally to FIGS. 6 and 7, an alternate embodiment of the curved elongate base 30' is now described. More particularly, the front wall 33' and the rear wall 34' of the curved elongate base 30' may be tapered. More specifically, the front wall 33' and rear wall 34' of the curved elongate base 30' may be configured in such a way that the curved bottom 31' meets the curved top 32' adjacent the front wall and rear wall of the curved elongate base.

The medial rib 36' may be tapered to the opposing sidewalls 35' of the curved elongate base 30'. In other words, the medial rib 36' may substantially overlie the curved bottom 31' of the curved elongate base 30'. Further, the medial rib 36' may have a high point along a medial portion of the curved bottom 31' of the curved elongate base 30', and opposing low points that meet the opposing sidewalls 35' of the curved elongate base.

Each of the plurality of auxiliary ribs 37' are illustratively tapered to the opposing sidewalls 35' of the curved elongate base 30'. More specifically, each of the plurality of auxiliary ribs 37' illustratively overlie the tapered medial rib 36' which, in turn, overlies the curved bottom 31' of the curved elongate base 30'. Further, the high point of each of the auxiliary ribs 37' is illustratively adjacent the high point of the medial rib 36', i.e., along the medial portion of the curved bottom 31' of the curved elongate base. Each of the plurality of auxiliary ribs 37' has a low point adjacent a respective one of the opposing sidewalls 35' of the curved elongate base 30'.

This configuration of the curved elongate base 30' may advantageously enhance stability of the walking assist device 10' when being used on a surface of loose material, such as beach sand, for example. The other elements of this embodiment of the curved elongate base 30' are similar to those of the first embodiment of the curved elongate base 30, are labeled with prime notation, and require no further discussion herein.

Figure 8:
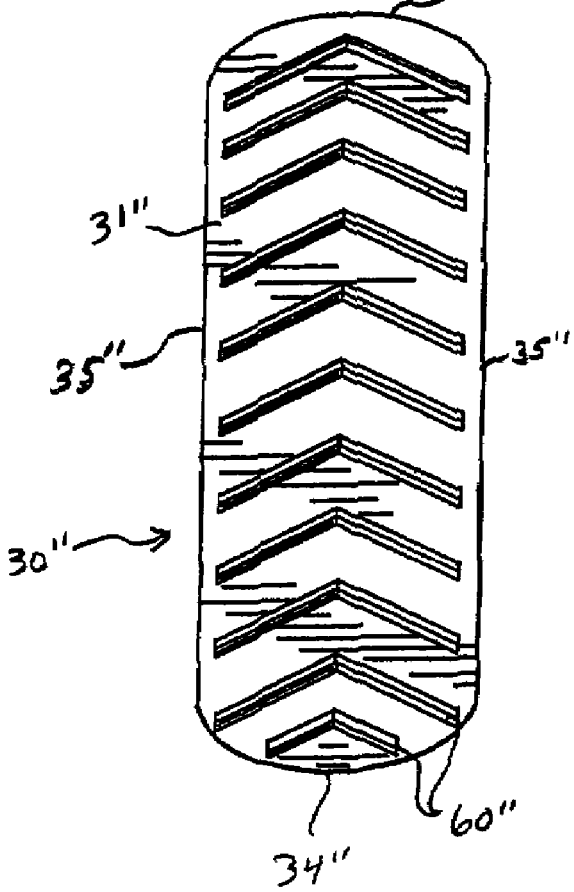
FIG. 8 is a bottom plan view of another embodiment of the curved elongate base of the walking assist device according to the present invention.

Referring now additionally to FIG. 8, another embodiment of the curved elongate base 30" is now described in greater detail. The curved elongate base 30" has a major axis extending from the front wall 33" to the rear wall 34". The embodiment of the curved elongate base 30" illustrated in FIG. 8 includes a plurality of spaced apart ribs 60" connected to and extending outwardly from the curved bottom 31". Each of the plurality of spaced apart ribs 60" extends laterally between the opposing sidewalls 35" of the curved elongate base 30". In other words, each of the plurality of spaced apart ribs 60" may extend substantially perpendicular to the major axis.

Each of plurality of spaced apart ribs 60" are preferably positioned parallel to one another along the curved bottom 31" of the curved elongate base 30". Each of the plurality of spaced apart ribs 60" preferably have a V-shape. The medial portion of each of the V-shaped ribs 60" is preferably aligned with the major axis. Those having skill in the art will appreciate that the ribs 60" adjacent the front wall 33" and rear wall 34" of the curved elongate base 30" may be shorter than those positioned adjacent medial portions of the curved elongate base. The other elements of this embodiment of the curved elongate base are similar to those of the first embodiment of the curved elongate base, are labeled with double prime notation, and require no further discussion herein.

Figure 9:
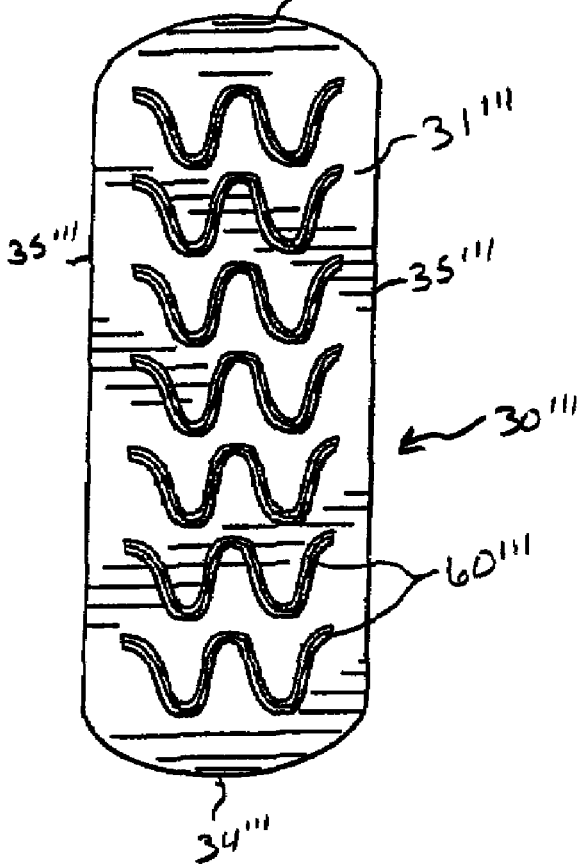
FIG. 9 is a bottom plan view of yet another embodiment of the curved elongate base of the walking assist device according to the present invention.

Referring now additionally to FIG. 9, yet another embodiment of the curved elongate base 30''' is now described in greater detail. In the embodiment of the curved elongate base 30''' illustrated in FIG. 9, the plurality of spaced apart ribs 60''' preferably have a W-shape. More specifically, the ends of the W-shaped spaced apart ribs 60''' may be curved outwardly. Similar to the embodiment of the curved elongate base 30" illustrated in FIG. 8, each of the plurality of spaced apart ribs 60''' of the embodiment of the curved elongate base 30''' illustrated in FIG. 9 preferably extend laterally between the opposing sidewalls 35''' of the curved elongate base, i.e., perpendicular to the major axis.

Each of the plurality of spaced apart ribs 60''' are preferably positioned parallel to one another. The other elements of this embodiment of the curved elongate base 30''' are similar to those of the first embodiment of the curved elongate base 30, are labeled with triple prime notation, and require no further discussion herein.

A method aspect of the present invention is for using a walking assist device 10. The method may comprise matingly engaging the curved elongate base 30 to a distal end of the elongate shaft 20. The method may also comprise moving the curved elongate base 30 between a use position matingly engaging the distal end of the elongate shaft 20, and a storage position matingly engaging a base storage member 40 on the elongate shaft.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A walking assist device comprising:

a first elongate shaft having a proximal end and a distal end;

a second elongate shaft having a proximal end and a distal end, the proximal end of said second elongate shaft slidably engaging the distal end of said first elongate shaft so that said first elongate shaft overlies said second elongate shaft;

a handle connected to the proximal end of said first elongate shaft;

a curved elongate base defined as a first base detachably connected to the distal end of said second elongate shaft, said curved elongate base comprising a curved bottom, a curved top overlying the curved bottom, a front wall, a rear wall, and opposing sidewalls, a medial rib connected to and extending outwardly from a medial portion of the curved bottom, the medial rib having a length substantially similar to a length of said curved elongate base, a plurality of auxiliary ribs extending outwardly from the curved bottom, and alternatingly spaced apart on opposing sides of the medial rib and each extending laterally from the medial rib substantially to the opposing sidewalls of said curved elongate base, and a connection member connected to and extending outwardly from the curved top to matingly engage the distal end of said second elongate shaft; and a base storage member connected to and extending outwardly from said first elongate shaft; and a second base that interchangeably connects to the distal end of said second elongate shaft.

2. A walking assist device according to claim 1 wherein said base storage member and said first elongate shaft are integrally formed as a monolithic unit.

3. A walking assist device according to claim 1 wherein said curved elongate base is movable between a storage position and a use position; and wherein the connection member on said curved elongate base matingly engages the base storage member when said curved elongate base is in the storage position.

4. A walking assist device according to claim 1 wherein said second base is moveable between a storage position and a use position; and wherein said second base matingly engages the base storage member on said first elongate shaft when said second base is in the storage position.

5. A walking assist device according to claim 1 wherein said second base has a bottom, sidewalls, and an open top having a diameter slightly larger than said second elongate shaft so that said second base may slidably engage at least one of the distal end of said second elongate shaft and the base storage member.

6. A walking assist device according to claim 1 wherein said first elongate shaft has a first predetermined diameter, and said second elongate shaft has a second predetermined diameter less than the first predetermined diameter.

7. A walking assist device according to claim 1 wherein said curved bottom, curved top, front wall, rear wall, opposing sidewalls, medial rib, plurality of auxiliary ribs, and connection member are integrally formed as a monolithic unit.

8. A walking assist device according to claim 1 wherein said handle is shaped to contour a hand of a user.

9. A walking assist device according to claim 1 wherein said first and second elongate shafts each include at least one pair of opposing shaft passageways formed therein so that respective pairs of opposing shaft passageways may align when said second elongate shaft slidably engages said first elongate shaft; and further comprising at least one shaft fastener for engaging the respective pairs of opposing shaft passageways.

10. A walking assist device according to claim 1 wherein the connection member includes at least one pair of opposing connection member passageways formed therein; wherein the second elongate shaft includes at least one pair of opposing connection member passageways formed therein; and further comprising at least one base fastener for engaging the respective pairs of opposing connection member passageways to thereby fasten said curved elongate base to the distal end of said second elongate shaft.

11. A walking assist device according to claim 1 wherein the front wall of said curved elongate base is a tapered front wall; and wherein the rear wall of said curved elongate base is a tapered rear wall.

12. A walking assist device according to claim 1 wherein said medial rib is tapered to the opposing sidewalls of said curved elongate base.

13. A walking assist device according to claim 1 wherein each of the plurality of auxiliary ribs are tapered to the opposing sidewalls of said curved elongate base.

14. A walking assist device comprising:

an elongate shaft having a proximal end and a distal end, said elongate shaft having an adjustable length;

a base storage member connected to and extending outwardly from said elongate shaft;

a handle detachably connected to the proximal end of said elongate shaft;

a curved elongate base that matingly engages the distal end of said elongate shaft, said curved elongate base having a curved top, a tapered front wall, a tapered rear wall, a pair of opposing sidewalls, and a curved bottom having a major axis extending longitudinally from the front wall to the rear wall, the curved elongate base comprising a plurality of spaced apart ribs connected to and extending outwardly from the curved bottom, each extending laterally between the opposing sidewalls of said curved elongate base, and a connection member connected to and extending outwardly from the curved top to matingly engage the distal end of said elongate shaft; and a second base that interchangeably connects to the distal end of said elongate shaft, said second base being moveable between a use position matingly engaging the distal end of said elongate shaft, and a storage position matingly engaging said base storage member;

the plurality of spaced apart ribs, curved top, front wall, rear wall, opposing sidewalls, curved bottom, and connection member being integrally formed as a monolithic unit;

wherein said curved elongate base is movable between a storage position and a use position; and wherein the connection member on said curved elongate base matingly engages said base storage member when said curved elongate base is in the storage position.

15. A walking assist device according to claim 14 wherein said plurality of spaced apart ribs are V-shaped ribs.

16. A walking assist device according to claim 14 wherein said plurality of spaced apart ribs are W-shaped ribs.

17. A walking assist device according to claim 14 wherein said base storage member and said first elongate shaft are integrally formed as a monolithic unit.

18. A walking assist device according to claim 14 wherein said handle is shaped to contour a hand of a user.

19. A walking assist device according to claim 14 wherein said elongate shaft comprises first and second elongate shafts that slidably engage one another; wherein each of said first and second elongate shafts comprises at least one pair of opposing shaft passageways formed therein so that respective pairs of shaft passageways may align when said second elongate shaft slidably engages said first elongate shaft; and further comprising at least one shaft fastener for engaging the respective pairs of opposing shaft passageways.

20. A walking assist device according to claim 14 wherein the connection member has at least one pair of opposing connection member passageway formed therein; wherein said second elongate shaft comprises at least one pair of opposing connection member passageways formed therein; and further comprising at least one base fastener for engaging respective pairs of opposing connection member passageways to thereby fasten said curved elongate base to said second elongate shaft.

21. A method for using a walking assist device comprising:

matingly engaging a curved elongate base to a distal end of an elongate shaft, the elongate shaft having an adjustable length, the curved elongate base having a curved top, a front wall, a rear wall, opposing sidewalls, and a curved bottom having a major axis extending longitudinally from the front wall to the rear wall, the curved elongate base comprising a plurality of spaced apart ribs connected to and extending outwardly from the curved bottom, each laterally extending between the opposing sidewalls, a connection member connected to and extending outwardly from the curved top to matingly engage the distal end of the elongate base, a medial rib connected to and extending outwardly from a medial portion of the curved bottom, wherein the plurality of spaced apart ribs are auxiliary ribs being alternatingly spaced apart on opposing sides of the medial rib and extending laterally from the medial rib substantially to the opposing sidewalls of the curved elongate base, moving the curved elongate base between a use position matingly engaging the distal end of the elongate shaft, and a storage position matingly engaging a base storage member on the elongate shaft;

wherein the curved elongate base is a first base; wherein the walking assist device further comprises a second base; and moving the second base between a use position matingly engaging the distal end of the elongate shaft, and a storage position matingly engaging the base storage member on the elongate shaft.

22. A method according to claim 21 wherein the plurality of spaced apart ribs are V-shaped ribs.

23. A method according to claim 21 wherein the plurality of spaced apart ribs are W-shaped ribs.

24. A method according to claim 21 wherein the front wall of the curved elongate base is a tapered front wall; and wherein the rear wall of the curved elongate base is a tapered rear wall.

25. A method according to claim 21 wherein the medial rib is tapered to the opposing sidewalls of the curved elongate base.

26. A method according to claim 21 wherein each of the plurality of auxiliary ribs are tapered to the opposing sidewalls of the curved elongate base.

27. A method according to claim 21 wherein the elongate shaft comprises a first and second elongate shaft that slidably engage one another.

28. A method according to claim 27 wherein each of the first and second elongate shafts includes at least one pair of opposing shaft passageways formed therein; and further comprising aligning respective pairs of opposing shaft passageways, and engaging the respective pairs of opposing shaft passageways with at least one shaft fastener.

29. A method according to claim 27 wherein the connection member includes at least one pair of opposing connection member passageways formed therein, wherein the second elongate shaft includes at least one pair of opposing connection member passageways formed therein, and wherein matingly engaging the curved elongate base to the distal end of the elongate shaft comprises engaging at least one base fastener with respective opposing pairs of connection member passageways on each of the connection member and second elongate shaft.

* * * * *